US009849690B2

(12) United States Patent
Shimosato

(10) Patent No.: US 9,849,690 B2
(45) **Date of Patent: *Dec. 26, 2017**

(54) THERMAL TRANSFER PRINTER AND NON-TEMPORARY STORAGE MEDIUM

(71) Applicant: TOSHIBA TEC KABUSHIKI KAISHA, Shinagawa-ku, Tokyo (JP)

(72) Inventor: Toshiharu Shimosato, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/229,240

(22) Filed: Aug. 5, 2016

(65) Prior Publication Data

US 2017/0036454 A1 Feb. 9, 2017

Related U.S. Application Data

(63) Continuation of application No. 14/816,209, filed on Aug. 3, 2015, now Pat. No. 9,434,178.

(51) Int. Cl.

| | |
|---|---|
| ***B41J 2/325*** | (2006.01) |
| ***B41J 17/07*** | (2006.01) |
| ***B41J 35/08*** | (2006.01) |

(52) U.S. Cl.

CPC ..... *B41J 2/325* (2013.01); *B41J 17/07* (2013.01); *B41J 35/08* (2013.01)

(58) Field of Classification Search

CPC ... B41J 2/325; B41J 35/08; B41J 17/07; B41J 11/00; B41J 11/0005; B41J 11/001; B41J 11/0015; B41J 11/004; B41J 11/0045; B41J 11/005

See application file for complete search history.

(56) References Cited

U.S. PATENT DOCUMENTS

| | | | | |
|---|---|---|---|---|
| 5,529,410 | A | 6/1996 | Hunter et al. | |
| 7,119,823 | B2 | 10/2006 | Takahashi et al. | |
| 2006/0198682 | A1 | 9/2006 | Tsuchiya | |
| 2012/0105566 | A1 | 5/2012 | Ishii et al. | |
| 2013/0286140 | A1* | 10/2013 | Matsuda | B41J 2/325 347/218 |

FOREIGN PATENT DOCUMENTS

| | | |
|---|---|---|
| JP | 08-312568 | 11/1996 |
| JP | 2001-334695 | 12/2001 |
| JP | 2003182197 | * 7/2003 |

OTHER PUBLICATIONS

Non-Final Office Action for U.S. Appl. No. 14/816,209 dated Dec. 17, 2015.

* cited by examiner

*Primary Examiner* — Kristal Feggins
(74) *Attorney, Agent, or Firm* — Amin, Turocy & Watson LLP

(57) ABSTRACT

In accordance with one embodiment, a thermal transfer printer comprises a ribbon feeding roller configured to feed an ink ribbon including an ink layer on a base film; a ribbon winding roller configured to wind the ink ribbon fed from the ribbon feeding roller; a print head configured to heat the ink ribbon from a surface provided with no ink layer to selectively transfer the ink layer to paper; and a control section configured to control to apply an appropriate tension to the ink ribbon between the ribbon feeding roller and the ribbon winding roller according to the type of the ink ribbon.

10 Claims, 10 Drawing Sheets

SEMI-RESIN-1 TYPE

SEMI-RESIN-2 TYPE

FIG.11A

| MODEL NAME OF RIBBON | APPLICATION CONTROL (TYPE OF INK RIBBON) |
|---|---|
| BR-0001A | WAX |
| BR-0001B | WAX |
| CR-0020F | SEMI-RESIN-1 |
| CR-0020H | SEMI-RESIN-1 |
| DR-0010C | SEMI-RESIN-2 |
| DR-0040E | SEMI-RESIN-2 |
| DR-0040G | SEMI-RESIN-2 |
| ER-····· | RESIN |

FIG.11B

| APPLICATION CONTROL (TYPE OF INK RIBBON) | PRINTING SPEED (i/s) | TENSION (g/cm² ) |
|---|---|---|
| WAX | 3 、 5 | 160 |
| WAX | 8, 10, 12 | 170 |
| SEMI-RESIN-1 | 3, 5, 8 | 185 |
| SEMI-RESIN-1 | 10, 12, 14 | 195 |
| SEMI-RESIN-2 | 3, 5, 8 | 200 |
| SEMI-RESIN-2 | 10, 12, 14 | 210 |
| RESIN | 3, 5, 8 | 250 |

FIG.13

RIBBON WIDTH 110mm

| | | |
|---|---|---|
| CORRESPONDING PAPER WIDTH UPPER LIMIT | 105mm | 94mm |
| CORRESPONDING PAPER WIDTH LOWER LIMIT | 95mm | 85mm |
| WINDING VOLTAGE CORRECTION AMOUNT | ± 0V | -1V |
| FEEDING VOLTAGE CORRECTION AMOUNT | ± 0V | -0.5V |

FIG.14

RIBBON WIDTH 90mm

| | | |
|---|---|---|
| CORRESPONDING PAPER WIDTH UPPER LIMIT | 84mm | 74mm |
| CORRESPONDING PAPER WIDTH LOWER LIMIT | 75mm | 65mm |
| WINDING VOLTAGE CORRECTION AMOUNT | -2V | -3V |
| FEEDING VOLTAGE CORRECTION AMOUNT | -1V | -1.5V |

FIG.15

RIBBON WIDTH 70mm

| | | |
|---|---|---|
| CORRESPONDING PAPER WIDTH UPPER LIMIT | 64mm | 54mm |
| CORRESPONDING PAPER WIDTH LOWER LIMIT | 55mm | 45mm |
| WINDING VOLTAGE CORRECTION AMOUNT | -4V | -5V |
| FEEDING VOLTAGE CORRECTION AMOUNT | -2V | -2.5V |

FIG.16

RIBBON WIDTH 50mm

| | | |
|---|---|---|
| CORRESPONDING PAPER WIDTH UPPER LIMIT | 44mm | 34mm |
| CORRESPONDING PAPER WIDTH LOWER LIMIT | 35mm | 25mm |
| WINDING VOLTAGE CORRECTION AMOUNT | -6V | -7V |
| FEEDING VOLTAGE CORRECTION AMOUNT | -3V | -3.5V |

THERMAL TRANSFER PRINTER AND NON-TEMPORARY STORAGE MEDIUM

CROSS-REFERENCE TO RELATED APPLICATIONS

This application is a Continuation of application Ser. No. 14/816,209 filed on Aug. 3, 2015, the entire contents of which are incorporated herein by reference.

FIELD

Embodiments described herein relate generally to a thermal transfer printer that feeds an ink ribbon provided with an ink layer and a non-temporary storage medium.

BACKGROUND

A thermal transfer printer arranges a thermal head and a platen roller opposite to each other across a paper conveyance path and arranges an ink ribbon between paper conveyed on the paper conveyance path and the thermal head to carry out thermal transfer printing. The ink ribbon is wound around a ribbon feeding roller, and the ink ribbon fed from the ribbon feeding roller passes through the space between the paper and the thermal head and is then wound around a ribbon winding roller.

On the other hand, a ribbon winding motor for driving and rotating the ribbon winding roller in one direction and a ribbon feeding motor for driving and rotating the ribbon feeding roller in a direction opposite to the direction of the ribbon winding roller are arranged in the thermal transfer printer. The ribbon winding roller is rotated through a force stronger than the force applied to the ribbon feeding roller, and in this way, the ink ribbon is fed in a state of being applied with an appropriate tension. In such a type of thermal transfer printer, the thermal head and the platen roller are arranged opposite to each other in a width direction orthogonal to the conveyance direction of the paper conveyed on the paper conveyance path in one direction.

Incidentally, the ink ribbon includes a plurality of types such as resin type ink ribbon, semi-resin type ink ribbon, wax type ink ribbon and the like, and there are thermal transfer printers coping with the plurality of types of ink ribbons. In such a printer, if an appropriate tension is not applied to each ink ribbon when the type of the ink ribbon changes, wrinkles may be caused in the ink ribbon, which leads to a decrease in the printing quality.

To prevent the decrease in the printing quality caused by such a reason, the voltages to be respectively applied to the ribbon winding motor and the ribbon feeding motor must be adjusted manually according to the type of the ink ribbon to be used, the type of the paper, and further the printing speed.

The present invention provides a thermal transfer printer always capable of carrying out high-quality printing according to the ink ribbon to be used.

BRIEF DESCRIPTION OF THE DRAWINGS

FIG. 11A is a diagram illustrating an example of a table for determining an application control (the type of the ink ribbon) according to a model name of the ink ribbon according to the embodiment;

FIG. 11B is a diagram illustrating an example of an ink ribbon driving table according to the embodiment;

FIG. 13 is a diagram illustrating an example of the relation between a winding voltage and a feeding voltage in a case in which the width of the ink ribbon is 110 mm;

FIG. 14 is a diagram illustrating an example of the relation between the winding voltage and the feeding voltage in a case in which the width of the ink ribbon is 90 mm;

FIG. 15 is a diagram illustrating an example of the relation between the winding voltage and the feeding voltage in a case in which the width of the ink ribbon is 70 mm;

FIG. 16 is a diagram illustrating an example of the relation between the winding voltage and the feeding voltage in a case in which the width of the ink ribbon is 50 mm.

DETAILED DESCRIPTION

In accordance with one embodiment, a thermal transfer printer comprises a ribbon feeding roller configured to feed an ink ribbon including an ink layer on a base film; a ribbon winding roller configured to wind the ink ribbon fed from the ribbon feeding roller; a print head configured to heat the ink ribbon from a surface provided with no ink layer to selectively transfer the ink layer to paper; and a control section configured to control to apply an appropriate tension to the ink ribbon between the ribbon feeding roller and the ribbon winding roller according to the type of the ink ribbon.

(Embodiment)

Hereinafter, one embodiment of the present invention is described with reference to the accompanying drawings.

Figure 1:
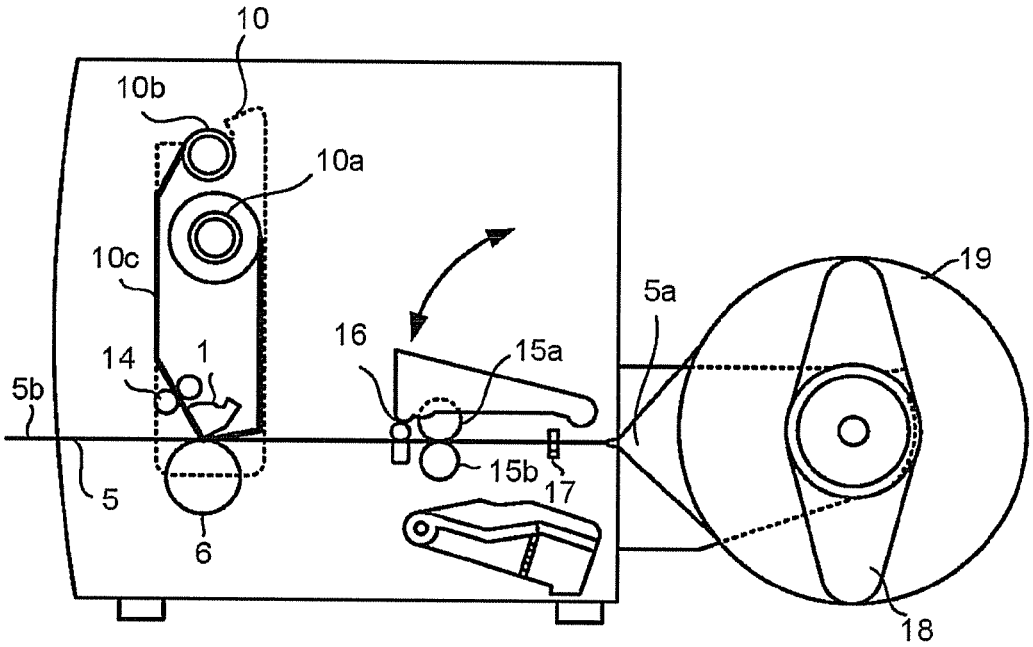
FIG. 1 is a diagram illustrating the schematic constitution of a thermal transfer printer according to one embodiment.

FIG. 1 is a diagram illustrating the schematic constitution of a thermal transfer printer according to one embodiment applied to a label printer. In the thermal transfer printer, a print head 1 for printing with black ink is arranged along a paper conveyance path 5. A platen roller 6 is arranged opposite to the print head 1 across the conveyance path 5.

The print head 1 is a thermal head at the end face of which is arranged a plurality of heating resistors, and a ribbon magazine 10 is detachably set nearby the print head 1.

The ribbon magazine 10 is provided with a ribbon feeding roller 10*a* and a ribbon winding roller 10*b*. The ribbon magazine 10 feeds, under the driving of a motor, the unused (new) ink ribbon 10*c* wound around the ribbon feeding roller 10*a* to the print head 1, and winds the ink ribbon 10*c* passing through the print head 1 around the ribbon winding roller 10*b*.

A ribbon width sensor 14 for detecting the width of the ink ribbon 10*c* conveyed inside the ribbon magazine 10 is arranged nearby the print head 1. The ribbon width sensor 14 is, for example, an optical transmission sensor.

One end of the conveyance path 5 is used as a paper supply port 5*a* and the other end is used as a paper discharge port 5*b*. At the side of the paper supply port 5*a* are arranged a pair of paper conveyance rollers 15*a* and 15*b* arranged opposite to each other across the paper, a paper width sensor 16, a paper rear end sensor 17 including an optical transmission sensor capable of detecting the paper rear end, and a paper holder 18.

The paper width sensor 16 detects the paper front end and the paper width. The paper rear end sensor 17 detects the rear end of the paper. The paper width sensor 16 and the paper rear end sensor 17 are, for example, optical transmission sensors capable of detecting the paper ends.

The paper holder 18 winds the paper 19 which is continuous roll paper. The paper 19 is nipped between the paper conveyance rollers 15*a* and 15*b* to be conveyed on the conveyance path 5 towards the paper discharge port 5*b*.

In such a constitution, the ribbon magazine 10 provided with the black ink ribbon 10*c* is generally set nearby the print head 1. In this case, the width of the ink ribbon 10*c* is uniquely determined according to the width of the paper 19, and user sets the ribbon magazine 10 provided with the ink ribbon 10*c* of which the width corresponds to the width of the paper 19 used.

Incidentally, in the present embodiment, four types of ink ribbons having a ribbon width of 110 mm, 90 mm, 70 mm and 50 mm can be used. In a case in which the paper width is in a range from 85 mm to 105 mm, the ink ribbon having a ribbon width of 110 mm is used. In a case in which the paper width is in a range from 65 mm to 85 mm, the ink ribbon having a ribbon width of 90 mm is used. In a case in which the paper width is in a range from 45 mm to 65 mm, the ink ribbon having a ribbon width of 70 mm is used. In a case in which the paper width is in a range from 25 mm to 45 mm, the ink ribbon having a ribbon width of 50 mm is used.

Figure 2:
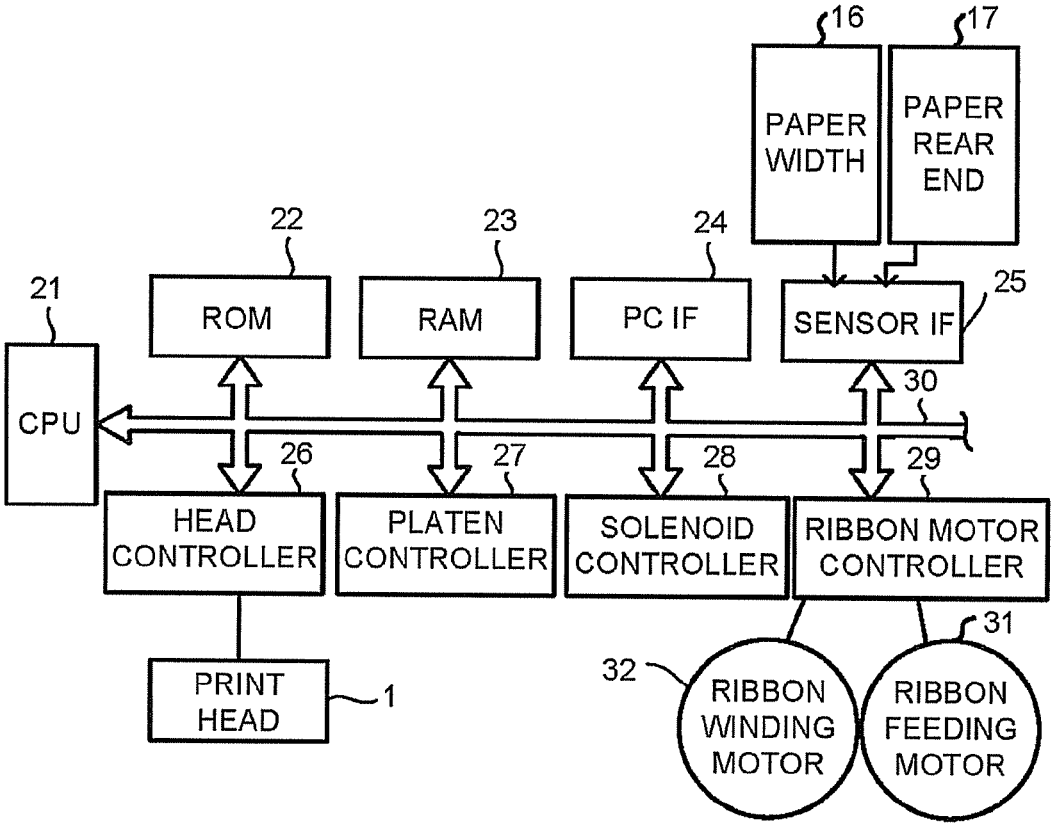
FIG. 2 is diagram illustrating an example of the circuit constitution of the main portions of the thermal transfer printer shown in FIG. 1.

FIG. 2 is a block diagram illustrating the circuit constitution of the main portions of the thermal transfer printer according to the present embodiment. The thermal transfer printer includes a CPU (Central Processing Unit) 21 as a main control section.

The thermal transfer printer includes a ROM (Read Only Memory) 22, a RAM (Random Access Memory) 23, a PC interface (IF) 24 and a sensor interface (IF) 25.

The ROM (Read Only Memory) 22 stores program data and the like of the processing carried out by the CPU 21 in advance. The RAM (Random Access Memory) 23 forms various memory areas such as a print buffer on which printing data is copied or decompressed. The PC interface (IF) 24 controls data communication with a personal computer in which data for printing is stored. The sensor interface (IF) 25 acquires signals from various sensors such as the ribbon width sensor 14, paper width sensor 16 and the paper rear end sensor 17.

The thermal transfer printer includes a head controller 26, a platen controller 27, a solenoid controller 28, a ribbon motor controller 29 and the like.

The head controller 26 controls the energization of the print head 1. The platen controller 27 controls the driving of platen motors (not shown) for rotating the platen roller 6 and the paper conveyance rollers 15*a* and 15*b*.

The solenoid controller 28 controls the driving of a solenoid mechanism (not shown) for lifting and lowering the print head 1 to contact and separate the print head 1 with/from the platen roller 6 arranged opposite to the print head 1. The ribbon motor controller 29 controls the driving of a ribbon feeding motor 31 and a ribbon winding motor 32 serving as DC motors for respectively rotating the ribbon feeding roller 10*a* and the ribbon winding roller 10*b* of the ink ribbon 10*c*.

The CPU 21 is connected with the ROM 22, the RAM 23, the PC interface 24, the sensor interface 25 and the controller 26 through a bus line 30 such as an address bus, data bus and the like to constitute a control circuit of the thermal transfer printer.

The ribbon feeding motor 31 rotates the ribbon feeding roller 10*a* of the ribbon magazine 10 provided with the black (K) ink ribbon. The ribbon winding motor 32 rotates the ribbon winding roller 10*b* of the ribbon magazine 10.

In the thermal transfer printer with such a constitution, it is important to apply an appropriate tension to the ink ribbon. The tension is determined by the rotation force of the ribbon winding roller 10*b* and the rotation force of the ribbon feeding roller 10*a*.

In the ROM 22 is formed a voltage setting table 41 in which the driving voltage (the so-called "winding voltage") of the ribbon winding motor 32 for rotating the ribbon winding roller 10*b* and the driving voltage (the so-called "feeding voltage") of the ribbon feeding motor 31 for rotating the ribbon feeding roller 10*a* are set in advance. Generally, the winding voltage is set to be greater than the feeding voltage to apply an appropriate tension to the ink ribbon. Incidentally, in the present embodiment, the winding voltage is set to 15V and the feeding voltage is set to 10V.

The appropriate tension of the ink ribbon is changed according to the type of the ink ribbon as well as the width of the ink ribbon, the width and the category of the paper and the like. The type of the ink ribbon used in the present embodiment is described. The used ink ribbon includes four types, that is, wax type, semi-resin-1 type, semi-resin-2 type and resin type.

Figure 3:
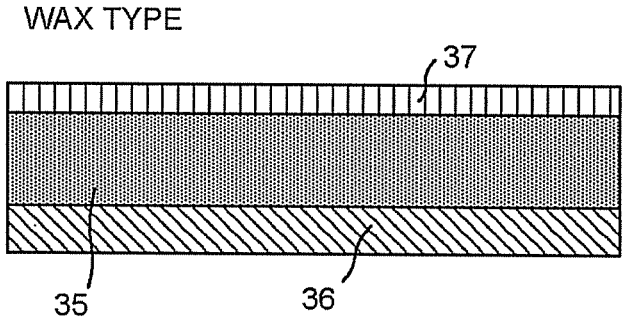
FIG. 3 is a diagram illustrating the structure of a wax type ink ribbon according to the embodiment.
Figure 4:
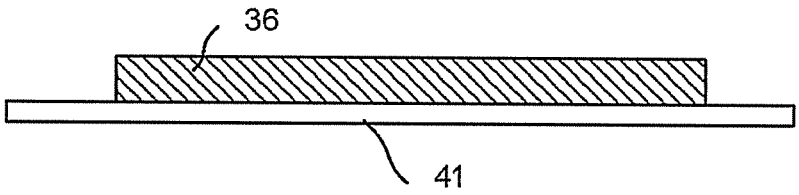
FIG. 4 is a diagram illustrating the structure in which the ink ribbon shown in FIG. 3 is transferred to receiving paper.

FIG. 3 is a diagram illustrating the cross-section structure of the wax type ink ribbon. Such a type of ink ribbon is formed by, for example, arranging an ink layer 36 obtained by mixing carbon with various waxes on a base film 35 having a thickness of about 3.5~6.0 μm and a back coating layer 37 on the back side of the base film 35. The back coating layer 37 is arranged to facilitate the sliding of the print head 1. FIG. 4 is a diagram illustrating a state in which the ink layer 36 is transferred to the receiving paper (paper) 41 from the wax type ink ribbon. The ink layer 36 of the wax type ink ribbon is exposed, thus, the ink can be transferred to the paper through pressure even if the heating of the print head is small.

Figure 5:
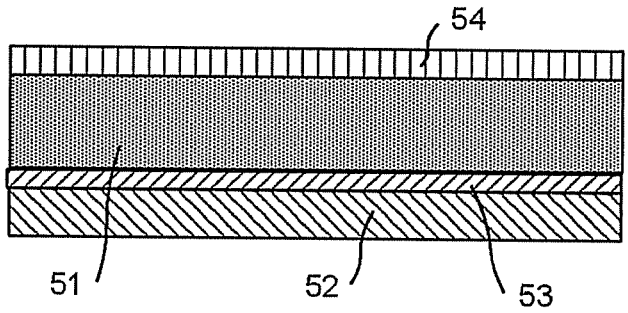
FIG. 5 is a diagram illustrating the structure of a semi-resin-1 type ink ribbon according to the embodiment.

FIG. 5 is a diagram illustrating the cross-section structure of the semi-resin-1 type ink ribbon. The semi-resin type includes the semi-resin-1 type and the semi-resin-2 type. The semi-resin-2 type is formed by arranging an overcoat layer on the ink layer as stated below.

Figure 6:
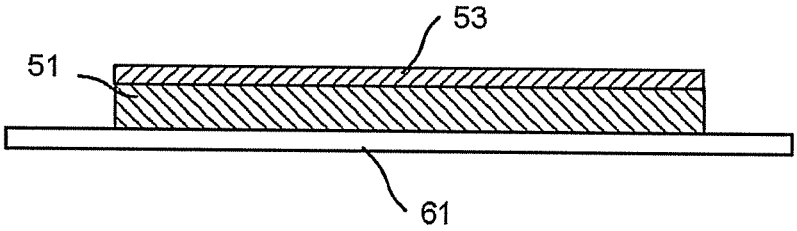
FIG. 6 is a diagram illustrating the structure in which the ink ribbon shown in FIG. 5 is transferred to the receiving paper.

As to the structure of the semi-resin-1 type, an ink layer 52 is arranged on the base film 51 across a peeling layer 53, and a back coating layer 54 is arranged at the back side of the base film 51. FIG. 6 is a diagram illustrating a state in which the ink is transferred to receiving paper (paper) 61 from the semi-resin-1 type ink ribbon shown in FIG. 5. In a case of using such a semi-resin-1 type ink ribbon, there is an advantage that the ink layer 52 can be transferred easily due to the existence of the peeling layer 53.

Figure 7:
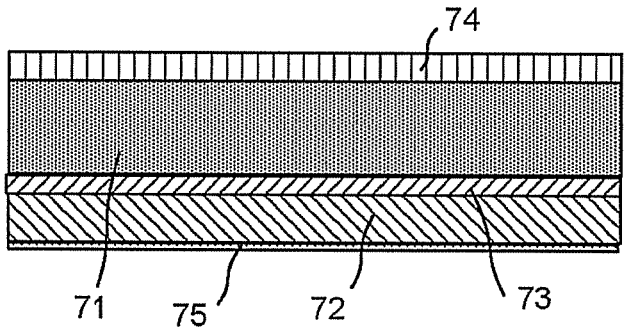
FIG. 7 is a diagram illustrating the structure of a semi-resin-2 type ink ribbon according to the embodiment.

FIG. 7 is a diagram illustrating the cross-section structure of the semi-resin-2 type ink ribbon. As to the structure of the semi-resin-2 type ink ribbon, an ink layer 72 is arranged on the base film 71 across a peeling layer 73, and a back coating layer 74 is arranged at the back side of the base film 71. Furthermore, an overcoat layer 75 is arranged on the ink layer 72.

Figure 8:
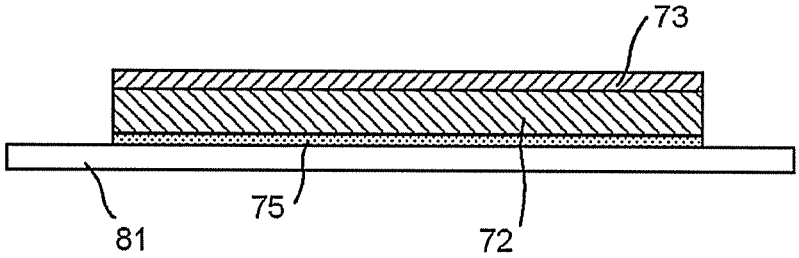
FIG. 8 is a diagram illustrating the structure in which the ink ribbon shown in FIG. 7 is transferred to the receiving paper.

FIG. 8 is a diagram illustrating a state in which the ink is transferred to receiving paper (paper) 81 from the semi-resin-2 type ink ribbon shown in FIG. 7. In a case of using such a semi-resin-2 type ink ribbon, there is an advantage that the ink layer 72 can be transferred easily due to the existence of the peeling layer 73. The semi-resin-2 type ink ribbon further includes the overcoat layer 75, thus, the ink layer 72 is not contacted with the receiving paper 81 directly, which prevents the receiving paper 81 from being contaminated due to the transfer pressure. There is another advantage that the adhesion between the ink layer and the receiving paper 81 can be improved through the overcoat layer 75.

Figure 9:
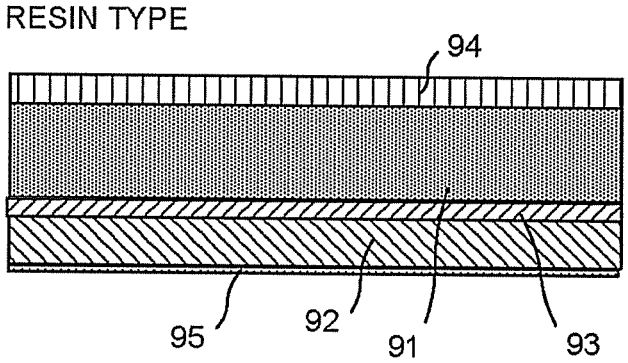
FIG. 9 is a diagram illustrating the structure of a resin type ink ribbon according to the embodiment.

FIG. 9 is a diagram illustrating the cross-section structure of the resin type ink ribbon. As to the structure of the resin type ink ribbon, an ink layer 92 is arranged on the base film 91 across a peeling layer 93, and a back coating layer 94 is arranged at the back side of the base film 91. Furthermore, an overcoat layer 95 is arranged on the ink layer 92.

Figure 10:
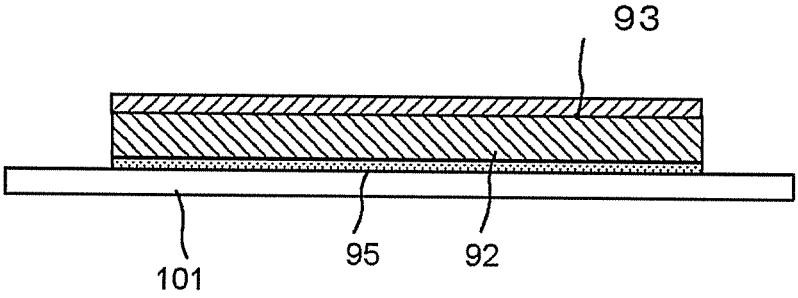
FIG. 10 is a diagram illustrating the structure in which the ink ribbon shown in FIG. 9 is transferred to the receiving paper.

FIG. 10 is a diagram illustrating a state in which the ink is transferred to receiving paper (paper) 101 from the resin type ink ribbon shown in FIG. 9. In a case of using such a resin type ink ribbon, there is an advantage that the ink layer 92 can be transferred easily due to the existence of the peeling layer 93.

The resin type ink ribbon further includes the overcoat layer 95, thus, the ink layer 92 is not contacted with the receiving paper 101 directly, which prevents the receiving paper 101 from being contaminated due to the transfer pressure. There is another advantage that the adhesion between the ink layer and the receiving paper 101 can be improved through the overcoat layer 95.

Next, the relation between the ink ribbon model name, the printing speed, the application control and the tension is described. FIG. 11 is an example of ribbon model name tension tables illustrating the relation. The tables include each column 111, 112, 113 and 114 of the ink ribbon model name, the printing speed (i/s), the application control and the tension (g/cm$^2$). It is assumed that the paper used in the thermal transfer printer is the same normal paper. The printing speed of the thermal transfer printer includes four types: 3, 5, 8 and 10 i/s (inch/second). The ink ribbon model name is input by the user of the printer. If the printing speed for the ink ribbon model name is determined, the application control and the tension are determined.

The application control is the heating control in the print head 1. Only the type of the ink ribbon to be used is shown in the application control column of the table. However, the heating control may be controlled more finely according to various factors in practice, such as the width of the paper, the width of the ink ribbon, the continuity of the printing and the like, in addition to the type of the ink ribbon. The continuity of the printing refers to that it is necessary to suppress the heating in a case of carrying out printing continuously, that is, in a case in which a pre-determined voltage is applied to the corresponding element just before. However, basically, the heating control is carried out by specifying the winding voltage and the feeding voltage according to the type of the ink ribbon.

Next, the appropriate tension in a case of a wax type ink ribbon, a semi-resin type ink ribbon and a resin type ink ribbon is described. Generally, it is preferred to increase the tension by 10% in a case of a resin type ink ribbon, compared with a case of a semi-resin type ink ribbon. Further, it is preferred to decrease the tension by 5% in a case of a wax type ink ribbon, compared with a case of a semi-resin type ink ribbon.

FIG. 11A is a diagram illustrating an example of a ribbon model name/application control table. In this table, if the ribbon model name is designated, the application control corresponding to the model name is shown. The application control mainly refers to the type of the ink ribbon. That is, the ribbon model name/application control table indicates the type of the ink ribbon supposed to be used for the model name of the ribbon. The type of the ink ribbon refers to, for example, any of the wax type, semi-resin-1 type, semi-resin-2 type and the resin type described above. An ink ribbon driving table S122 is stored in the RAM 23 shown in FIG. 2. For example, in a case in which the model name of the ink ribbon is BR-0001A, the appropriate ink ribbon is a wax type ink ribbon.

FIG. 11B is a diagram illustrating an example of the ink ribbon driving table. In the table, an appropriate tension is determined according to the application control (that is, the type of the ink ribbon) and the printing speed. For example, in a case in which the ink ribbon is a semi-resin-1 type ink ribbon and the printing speed is 8 (i/Sec), the appropriate tension is 185 g/cm$^2$.

Figure 12:
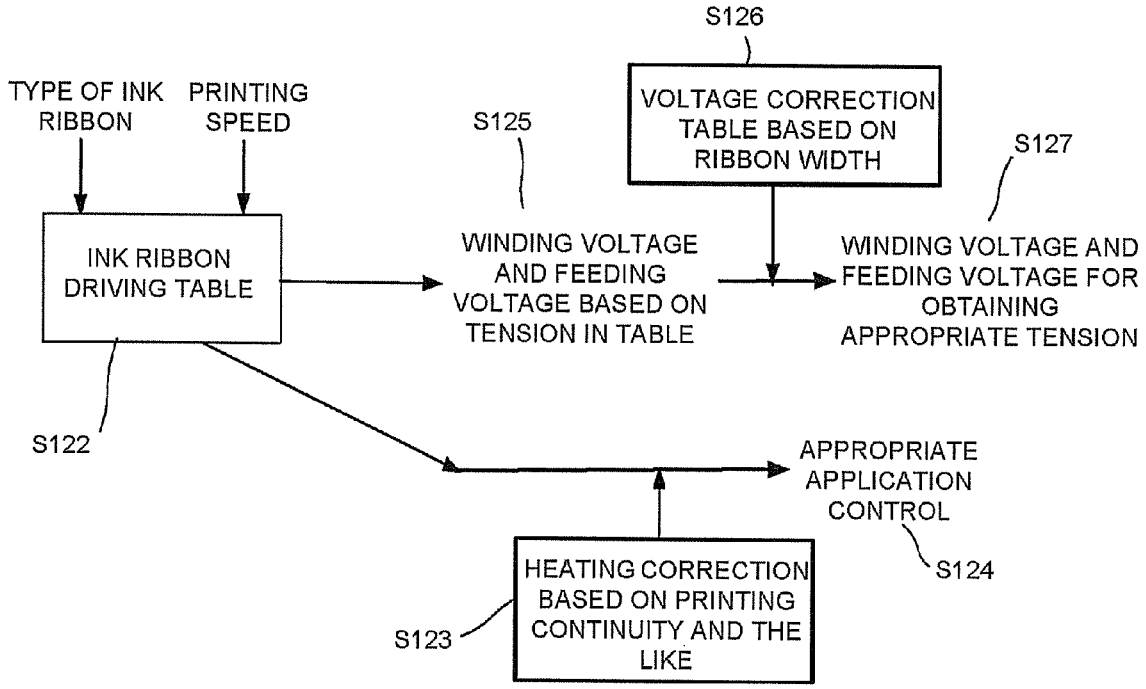
FIG. 12 is a diagram illustrating the relation for obtaining an appropriate tension and the like according to the type of the ink ribbon and a printing speed.

FIG. 12 is a diagram illustrating the relation for applying an appropriate tension to the ink ribbon and meanwhile carrying out an appropriate application control in the embodiment.

Even if the type of the ink ribbon is determined, the correction of the heating applied to the ink ribbon is carried out as shown in S123 according to the printing continuity, that is, according to whether or not printing is continued before the time point. In general cases, the heating of the print head is controlled with other factors taken into consideration, however, for the sake of simplicity, only the printing continuity is taken into consideration herein. The heating is corrected according to the printing continuity and the like as stated above, and the appropriate heating is carried out as shown in S124.

On the other hand, in the ink ribbon driving table S122, if the type of the ink ribbon and the printing speed are determined, an appropriate tension is output. As to the appropriate tension, the type of the ink ribbon input to the ink ribbon driving table S122 is also taken into account. To apply the appropriate tension, as shown in S125, the feeding voltage applied to the ribbon feeding motor 31 of the ribbon feeding roller 10*a* and the winding voltage applied to the ribbon winding motor 32 of the ribbon winding roller 10*b* are determined.

The feeding voltage and the winding voltage are corrected according to the ribbon width in S126. The feeding voltage and the winding voltage for making the tension appropriate may be corrected with other factors taken into consideration, however, only the voltage correction based on the difference of the ink ribbon width is shown herein.

The winding voltage and the feeding voltage are corrected based on the difference of ink ribbon width and the like as stated above, and the appropriate winding voltage is applied to the ribbon winding motor 32 in S127. On the other hand, the corrected feeding voltage is applied to the ribbon feeding motor, and an appropriate tension is applied to the ink ribbon 10*c*.

It is preferred to correct the winding voltage and the feeding voltage according to the width of the ink ribbon. The winding voltage and the feeding voltage obtained with the width taken into consideration are carried out by relatively adjusting the voltage value determined according to the application control as stated above.

Examples of corresponding paper width upper limit, corresponding paper width lower limit and the correction voltage amounts of the winding voltage and the feeding voltage for different ink ribbon widths are shown in FIG. 13, FIG. 14, FIG. 15 and FIG. 16. FIG. 13 shows a case in which the ink ribbon width is 110 mm. FIG. 14 shows a case in which the ink ribbon width is 90 mm. FIG. 15 shows a case in which the ink ribbon width is 70 mm. FIG. 16 shows a case in which the ink ribbon width is 50 mm. such a ribbon width correction value table for the ribbon width is formed in the ROM 22.

Incidentally, in the embodiment, as shown in the ribbon width correction value table in FIG. 13, for the ink ribbon having a ribbon width of 110 mm, both the winding voltage correction amount and the feeding voltage correction amount are set to ±0V in a case of using the paper having a paper width of 105 mm~95 mm; and the winding voltage correction amount and the feeding voltage correction amount are respectively set to −1V and −0.5V in a case of using the paper having a paper width of 94 mm~85 mm.

That is, in a case of using the paper having a paper width of 105mm~95mm, the winding voltage is set to 15V and the feeding voltage is set to 10V; in this way, the force applied to the ink ribbon is balanced and no wrinkle is caused in the ink ribbon. Further, in a case of using the paper having a paper width of 94 mm~85 mm, the winding voltage is set to 14V and the feeding voltage is set to 9.5V; in this way, the force applied to the ink ribbon is balanced and no wrinkle is caused in the ink ribbon.

Further, for the ink ribbon having a ribbon width of 90 mm, the winding voltage correction amount and the feeding voltage correction amount shown in FIG. 14 are respectively set to −2V and −1V in a case of using the paper having a paper width of 84 mm~75 mm; and the winding voltage correction amount and the feeding voltage correction amount are respectively set to −3V and −1.5V in a case of using the paper having a paper width of 74 mm~65 mm.

That is, in a case of using the paper having a paper width of 84 mm~75 mm, the winding voltage is set to 13V and the feeding voltage is set to 9V; in this way, the force applied to the ink ribbon is balanced and no wrinkle is caused in the ink ribbon. Further, in a case of using the paper having a paper width of 74 mm~65 mm, the winding voltage is set to 12V and the feeding voltage is set to 8.5V; in this way, the force applied to the ink ribbon is balanced and no wrinkle is caused in the ink ribbon.

Further, for the ink ribbon having a ribbon width of 70 mm, as shown in FIG. 15, the winding voltage correction amount and the feeding voltage correction amount are respectively set to −4V and −2V in a case of using the paper having a paper width of 64 mm~55 mm; and the winding voltage correction amount and the feeding voltage correction amount are respectively set to −5V and −2.5V in a case of using the paper having a paper width of 54 mm~45 mm.

That is, in a case of using the paper having a paper width of 64 mm~55 mm, the winding voltage is set to 11V and the feeding voltage is set to 8V; in this way, the force applied to the ink ribbon is balanced and no wrinkle is caused in the ink ribbon. Further, in a case of using the paper having a paper width of 54 mm~45 mm, the winding voltage is set to 10V and the feeding voltage is set to 7.5V; in this way, the force applied to the ink ribbon is balanced and no wrinkle is caused in the ink ribbon.

Further, for the ink ribbon having a ribbon width of 50 mm, as shown in FIG. 16, the winding voltage correction amount and the feeding voltage correction amount are respectively set to −6V and −3V in a case of using the paper having a paper width of 44 mm~35 mm; and the winding voltage correction amount and the feeding voltage correction amount are respectively set to −7V and −3.5V in a case of using the paper having a paper width of 34 mm~25 mm.

That is, in a case of using the paper having a paper width of 44 mm~35 mm, the winding voltage is set to 9V and the feeding voltage is set to 7V; in this way, the force applied to the ink ribbon is balanced and no wrinkle is caused in the ink ribbon. Further, in a case of using the paper having a paper width of 34 mm~25 mm, the winding voltage is set to 8V and the feeding voltage is set to 6.5V; in this way, the force applied to the ink ribbon is balanced and no wrinkle is caused in the ink ribbon.

Figure 17:
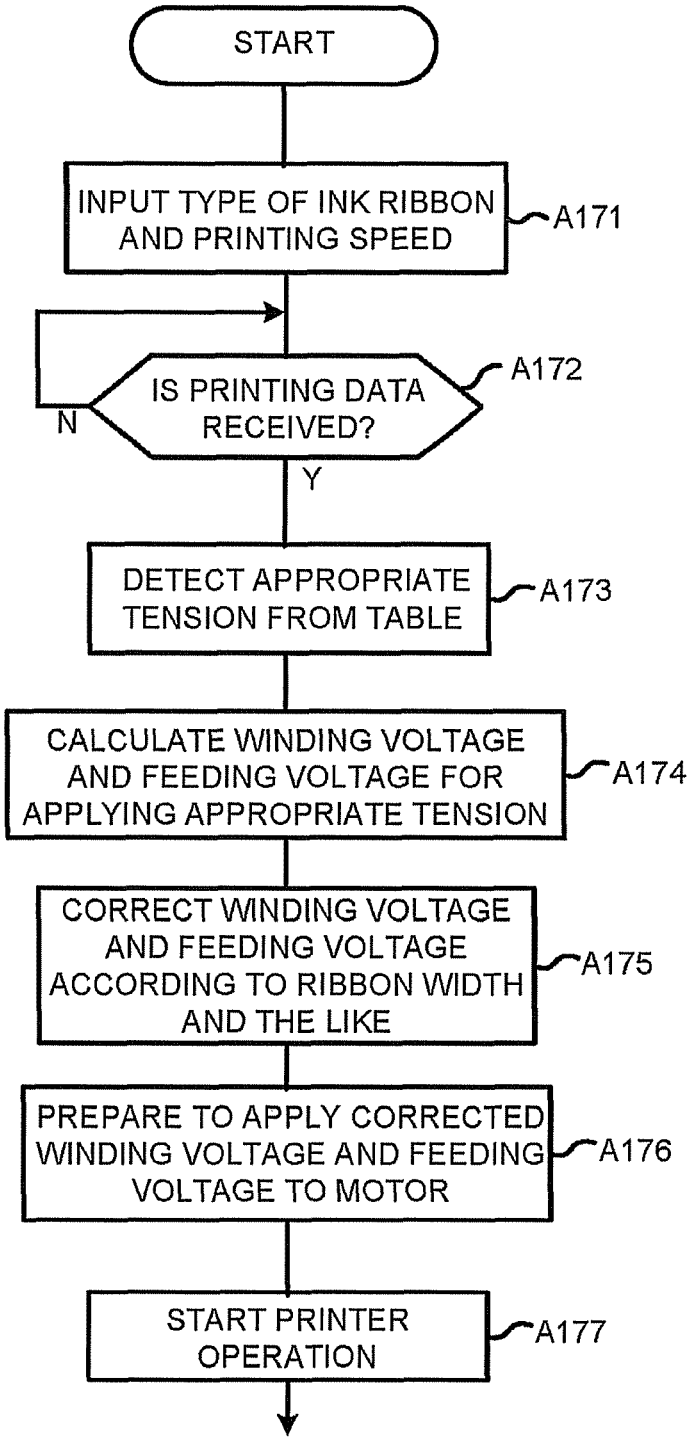
FIG. 17 is a flowchart illustrating operations for applying the appropriate tension to the ink ribbon according to the embodiment.

Next, the operations in the embodiment are described with reference to the flowchart shown in FIG. 17. Before the thermal transfer printer starts the printer operation, that is, when the power is turned on, the CPU 21 executes the ink ribbon driving control processing shown in the flowchart in FIG. 17 to apply an appropriate tension to the ink ribbon for carrying out printing.

In a case in which the printing preparation of the thermal transfer printer is started, the CPU 21 starts the ink ribbon driving control processing, and checks whether or not the type of the ink ribbon and the printing speed are input in ACT A171 first. The application control refers to the type of the ink ribbon to be used, that is, any of the wax type ink ribbon, the semi-resin-1 type ink ribbon, the semi-resin-2 type ink ribbon and the resin type ink ribbon in the present embodiment.

In ACT A172, it is detected whether or not the printing data is received. If the printing data is not received, the CPU 21 waits in the state. If the printing data is received, the processing in ACT A173 is carried out.

In ACT A173, the appropriate tension in this case is detected with the selected ink ribbon from the ink ribbon driving table S122.

In ACT A174, the winding voltage applied to the ribbon winding motor 32 and the feeding voltage applied to the ribbon feeding motor 31 corresponding to the detected tension are calculated by reference to the tension voltage table stored in the RAM 23.

The winding voltage and the feeding voltage obtained in ACT A174 are corrected in ACT A175.

First, the signal of the ribbon width sensor 14 is acquired through the sensor interface 25 shown in FIG. 2, and the ribbon width of the ink ribbon 10*c* in the ribbon magazine 10 is detected. Further, the signal of the paper width sensor 16 is acquired through the sensor interface 25, and the paper width of the paper 19 wound around the paper holder 18 is detected.

Next, the correction value table shown in FIG. 13-FIG. 16 for the detected ribbon width is read from the ROM 22, and it is determined whether or not the detected paper width is in the range of the corresponding paper width set in the correction value table.

If the paper width of the paper 19 to be used is in the range of the corresponding paper width, the winding voltage correction amount of the corresponding paper width to which the paper width belongs is acquired. Then it is determined whether or not the winding voltage correction amount is ±0V. If the winding voltage correction amount is not ±0V, the winding voltage setting value is read from the voltage setting table 41 of the ROM 22 and corrected with the winding voltage correction amount, and then applied to the ribbon motor controller 29. If the winding voltage correction amount is ±0V, the winding voltage setting value read from the voltage setting table 41 of the ROM 22 is applied to the ribbon motor controller 29 without executing correction.

Next, the feeding voltage correction amount of the corresponding paper width to which the paper width belongs is acquired. Then it is determined whether or not the feeding voltage correction amount is ±0V. If the feeding voltage correction amount is not ±0V, the feeding voltage setting value is read from the voltage setting table of the ROM 22 and corrected with the feeding voltage correction amount, and then applied to the ribbon motor controller 29. If the feeding voltage correction amount is ±0V, the original feeding voltage setting value read from the voltage setting table 41 of the ROM 22 is applied to the ribbon motor controller 29 without executing correction.

In this way, the winding voltage and the feeding voltage calculated in ACT A174 are corrected according to the ink ribbon width and the paper width in ACT A175.

Sequentially, in ACT A176, the CPU 21 executes preparation control of a general printing processing. In the printing processing, the ribbon motor controller 29 drives the ribbon winding motor 32 forward through the winding voltage applied from the CPU 21.

On the other hand, the ribbon feeding motor 31 is driven reversely through the feeding voltage applied from the CPU 21, and the ribbon winding roller 10*b* is rotated through a force stronger than the force applied to the ribbon feeding roller 10*a*; in this way, the ink ribbon 10*c* is fed in a state of being applied with an appropriate tension.

After an appropriate type of the ink ribbon is selected and an appropriate tension is applied to the ink ribbon as stated above, the operation of the printer is started in ACT A177.

The CPU 21 includes a retrieval module and a driving control module. The retrieval module retrieves the setting information according to the width information of the paper 19 detected by the paper width sensor 16 and the width information of the ink ribbon 10*c* detected by the ribbon width sensor 14. The setting information is stored in the ribbon width correction value tables shown in FIG. 13-FIG. 16. The retrieval module retrieves the setting information to acquire an optimum driving force. The driving control module drives the ink ribbon 10*c* based on the optimum driving force.

Specifically, the angular velocity of the ribbon feeding roller 10*a* and the ribbon winding roller 10*b* is detected for the ink ribbon 10*c*, and the reel diameters of the ribbon feeding side and the ribbon winding side are determined, and then the optimum driving force corresponding to the reel diameter of the ink ribbon is further adjusted.

In the present embodiment with such a constitution, for example, a case of carrying out printing on the paper 19 having a width of 100 mm using the ink ribbon 10*c* having a width of 110 mm is considered. In this case, the winding voltage and the feeding voltage are corrected according to the setting information of the paper width 105 mm~95 mm stored in the correction value table and then applied to the ribbon winding motor 32 and the ribbon feeding motor 31, respectively. At this time, the force to be applied to the ink ribbon is balanced, and no wrinkle is caused in the ink ribbon, thus, a high printing quality can be achieved.

In accordance with the present embodiment, the paper width sensor 16 is arranged as a paper width detection module for detecting the width of the paper 19 conveyed on the paper conveyance path 5, and the ribbon width sensor 14 is arranged as a ribbon width detection module for detecting the width of the ink ribbon 10*c*.

Further, the correction value tables shown in FIG. 13-FIG. 16 are arranged as storage modules for setting and storing the optimum driving force for feeding the ink ribbon 10*c* on the basis of the width information of the ink ribbon and the width information of the paper. However, the CPU 21 retrieves the setting information stored in the correction value tables according to the width information of the paper 19 detected by the paper width sensor 16 and the width information of the ink ribbon 10*c* detected by the ribbon width sensor 14 and acquires the optimum driving force. Then the driving force of the ink ribbon is adjusted automatically so that the ink ribbon 10*c* is fed through the optimum driving force, thus, a high printing quality can always be achieved even if the widths of the ink ribbon and the paper to be used are changed.

In the embodiment, the widths of the ink ribbon and the paper are detected by sensors respectively to acquire the width information of the ink ribbon and the width information of the paper; however, it is also applicable to input the width information of the ink ribbon and the width information of the paper from, for example, a personal computer connected through the PC interface 24, and then adjust the driving force of the ink ribbon according to the input width information of the ink ribbon and the width information of the paper.

It is also applicable to set and store the ribbon winding voltage and the ribbon feeding voltage serving as the optimum driving force for feeding the ink ribbon on the basis of the width information of the ink ribbon and the width information of the paper, and then extract and apply the ribbon winding voltage and the ribbon feeding voltage serving as the optimum driving force according to the width information of the paper detected by the paper width detection module and the width information of the ink ribbon detected by the ribbon width detection module.

In the embodiment described above, the type of the ink ribbon and the printing speed are input to determine an appropriate tension to be applied to the ink ribbon. However, if the type of the ink ribbon and the appropriate tension are not changed even if the printing speed is changed, it is applicable to input the type of the ink ribbon merely without inputting the printing speed.

In the embodiment described above, it is exemplified that the type of the ink ribbon includes the wax type, the semi-resin-1 type, the semi-resin-2 type and the resin type. However, it is not limited to this, and the present invention can be applied in a case of using less than three or more than five types of ink ribbons.

In the embodiment described above, the present invention is applied to a label printer. However, it is not limited to this, and the present invention can be applied to a thermal transfer printer other than the label printer.

As stated above, in accordance with the present embodiment, there can be provided a thermal transfer printer that can input the type of the ink ribbon to apply an appropriate tension to the ink ribbon to achieve a high printing quality.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A thermal transfer printer comprising:

a ribbon feeding roller configured to feed an ink ribbon including an ink layer on a base film;

a ribbon winding roller configured to wind the ink ribbon fed from the ribbon feeding roller;

a print head configured to heat the ink ribbon from a surface provided with no ink layer to selectively transfer the ink layer to paper and arranged in a width direction orthogonal to the conveyance direction of the paper;

an input section configured to input the type of the ink ribbon;

a ribbon width sensor configured to detect a length of the width direction of an ink ribbon;

a tension controller configured to determine a tension to be applied to the ink ribbon between the ribbon feeding roller and the ribbon winding roller, according to the type of the ink ribbon by the input section; and a controller configured to control a magnitude of the tension to be applied to the ink ribbon in association with the tension determined by the tension controller and the width information of the ink ribbon detected by the ribbon width sensor.

2. The thermal transfer printer according to claim 1, wherein the input section configured to input a printing speed, and the tension controller configured to determine a tension to be applied to the ink ribbon between the ribbon feeding roller and the ribbon winding roller, according to the type of the ink ribbon and the printing speed by the input section.

3. The thermal transfer printer according to claim 1, wherein the controller adjusts a winding voltage for driving a ribbon winding motor of roller and a feeding voltage for driving a ribbon feeding motor of roller.

4. The thermal transfer printer according to claim 3, wherein the controller corrects the winding voltage and the feeding voltage according to the width of the ink ribbon.

5. The thermal transfer printer according to claim 4, wherein the type of the ink ribbon are composed of a wax type, a semi-resin-1 type and a semi-resin-2 type.

6. A thermal transfer printing method comprising:

deciding a magnitude of a tension to be applied an ink ribbon between a ribbon feeding roller and a ribbon winding roller, according to a type of the ink ribbon by an input section, the input section being configured to input the type of the ink ribbon;

determining a tension to be applied to the ink ribbon between the ribbon feeding roller and the ribbon winding roller by a tension controller, according to the type of the ink ribbon by the input section; and controlling a second magnitude of the tension to the ink ribbon in association with the magnitude of the tension and width information of the ink ribbon detected by a ribbon width sensor, the ribbon width sensor being configured to detect a length of the width direction of the ink ribbon.

7. The thermal transfer printing method according to claim 6, wherein the input section configured to input a printing speed, and the tension controller configured to determine the tension to be applied to the ink ribbon between the ribbon feeding roller and the ribbon winding roller, according to the type of the ink ribbon and the printing speed by the input section.

8. The thermal transfer printing method according to claim 7, wherein the type of the ink ribbon are composed of a wax type, a semi-resin-1 type and a semi-resin-2 type.

9. The thermal transfer printing method according to claim 6, further comprising:

adjusting a winding voltage for driving a ribbon winding motor of roller and a feeding voltage for driving a ribbon feeding motor of roller.

10. The thermal transfer printing method according to claim 6, further comprising:

correcting the winding voltage and the feeding voltage according to the width of the ink ribbon.

* * * * *